United States Patent [19]

Barriuso et al.

[11] Patent Number: 4,758,186

[45] Date of Patent: Jul. 19, 1988

[54] SIDE CONNECTING TERMINAL BLOCK

[75] Inventors: Jean-Pierre Barriuso, Buchy; Jean-Luc Blin, Bosc le Hard; Guy Dubuc, Fontaine le Bourg; Daniel Paulin, Bosc le Hard; Alphonse Villenave, Canteleu, all of France

[73] Assignee: Legrand, Limoges, France

[21] Appl. No.: 889,268

[22] Filed: Jul. 25, 1986

[30] Foreign Application Priority Data

Jul. 25, 1985 [FR] France ..... 85 11373

[51] Int. Cl.[4] ..... H01R 9/26

[52] U.S. Cl. ..... 439/723

[58] Field of Search ..... 339/198 R, 198 G, 198 GA, 339/198 H, 263 R, 272 A, 272 R, 273 R; 439/709, 711, 712, 714, 715, 717, 721, 722, 723, 724

[56] References Cited

U.S. PATENT DOCUMENTS

| | | | |
|---|---|---|---|
| 3,201,747 | 8/1965 | Blanchet | 339/198 GA |
| 4,040,711 | 8/1977 | Waddington et al. | 339/198 R |
| 4,529,261 | 7/1985 | Stenz et al. | 339/272 R |

FOREIGN PATENT DOCUMENTS

| | | |
|---|---|---|
| 1572097 | 5/1969 | France . |
| 2071130 | 9/1971 | France . |
| 2117363 | 7/1972 | France . |
| 2234675 | 1/1975 | France . |
| 0542065 | 12/1941 | United Kingdom . |

*Primary Examiner*—Eugene F. Desmond

*Attorney, Agent, or Firm*—Charles E. Brown; Charles A. Brown

[57] ABSTRACT

A side connection terminal block of the kind comprises a generally tubular stirrup member fixed relative to an insulating material body common to two connecting terminals and laterally accessible at each end from the outside of the body through a lateral opening therein, for insertion of an electrical conductor. A clamping screw is immobilized axially relative to the stirrup member but relatively rotatable. A cable clamp presses the electrical conductor against a connecting link common to the two connecting terminals. The cable clamp which is disposed inside the stirrup member is prevented from rotating relative thereto and is interlocked with said clamping screw. The clamping screw is entirely disposed within the stirrup member common thereto.

14 Claims, 4 Drawing Sheets

FIG. 14
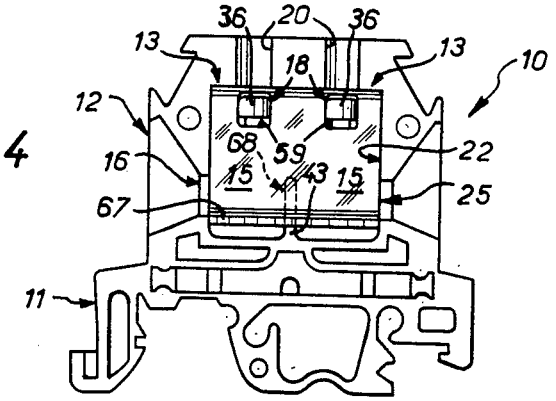
FIG. 15
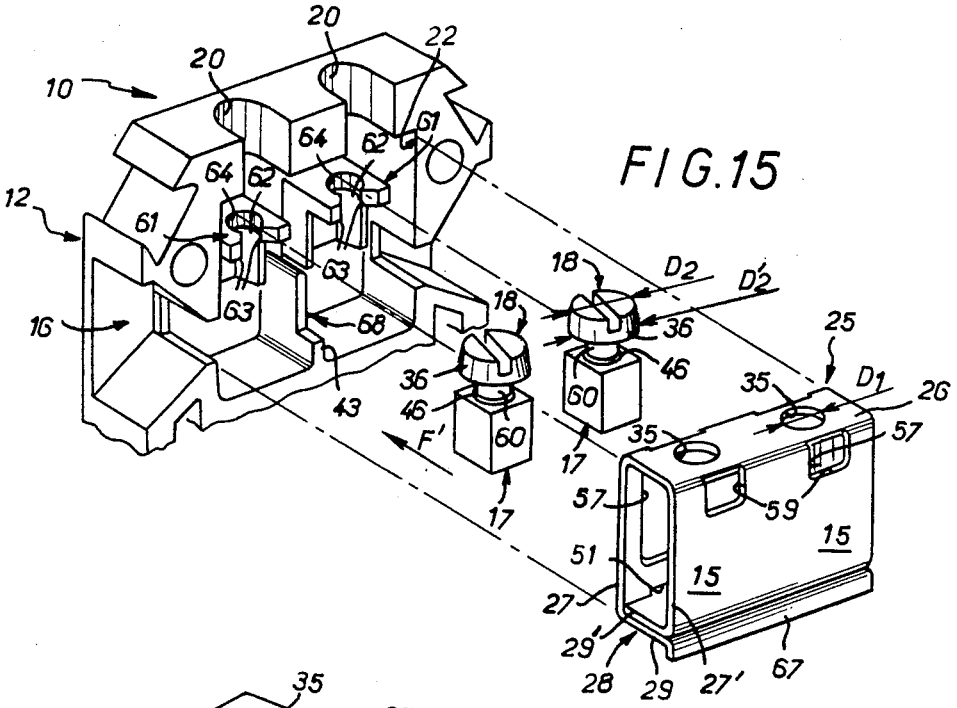
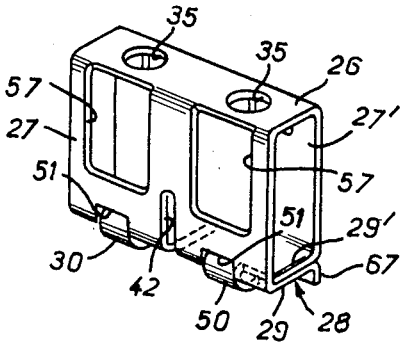
FIG. 16

SIDE CONNECTING TERMINAL BLOCK

The present invention is generally concerned with terminal blocks used to connect two electrical conductors.

It is directed more particularly to such terminal blocks which, to use the terminology adopted hereinafter for convenience only, are of the side connection type, meaning terminal blocks into which the conductors to be connected are inserted laterally, and thus transversely relative to the clamping action required to secure them.

As is known, a side connection terminal block generally comprises, within an insulating material body, at least two connecting terminals which are electrically connected to each other and each of which comprises, for clamping an electrical conductor, a generally tubular part, usually called the stirrup member, accessible from outside the insulating material body through a lateral opening in the latter, for said electrical conductor to be inserted in, and a cable clamp adapted to press said conductor against a wall of said stirrup member when acted on by a clamping screw.

At present two separate stirrup members are usually employed, one per connecting terminal, and there is associated with them, by way of a cable clamp, a connecting link common to the two stirrup members and extending from one to the other thereof which, over and above its cable clamping function, also procures the necessary electrical connection between the stirrup members.

The clamping screw of each connecting terminal is inserted in a threaded hole in the stirrup member with which it is associated and, while the stirrup member is mounted movably along the axis of the clamping screw in a housing provided for it in the insulating material body, said clamping screw is immobilized axially relative to the insulating material body, although it is free to rotate within it.

Thus when the bared end of an electrical conductor is inserted into the stirrup member of one connecting terminal, between the connecting link serving as a cable clamp and the wall of said stirrup member opposite that in which the associated clamping screw is captive, and the clamping screw is screwed in, said stirrup member, which forms a nut, is caused to move by the clamping screw in the direction towards the head thereof until, through said wall opposite said clamping screw, it clamps said bared end of said electrical conductor against said connecting link serving as a cable clamp.

An arrangement such as this has given and may still give satisfaction.

It has disadvantages, however, which increase its cost; these disadvantages are as follows.

A first disadvantage is associated with the actual construction of the stirrup members employed which, as is clearly shown by what has been said so far, have to feature a threaded hole for the associated clamping screw.

A stirrup member of this kind is usually cut from sheet metal and appropriately folded or stamped out from sheet metal.

Threading a hole in a part obtained in this way is a delicate operation which in practise cannot be carried out at a rate comparable with that of stamping machines, for example.

In other words, in the case of a stamped sheet metal stirrup member it is necessary to envisage either a significant reduction in productivity, in the order of 50%, if such threading is executed continuously on the same processing line downstream of the corresponding stamping machine, or to envisage a costly reprocessing of the parts concerned by feeding them in parallel to two or more threading stations on the upstream side of a stamping machine of this kind.

Also, after it has been stamped the sheet metal of the stirrup members concerned is significantly work hardened and therefore may be relatively hard.

Because of this, the taps used to thread them subsequently are inevitably subject to rapid wear, necessitating frequency changing and thus compromising overall productivity.

Finally, because of the relatively high hardness of the sheet metal to be worked, the threads are formed in the processed stirrup members under variable conditions, the sheet metal material mating with the threads of the taps employed to a variable degree.

Given these conditions, it is not unusual to observe gaps in the required threading and, even further compromising overall productivity, it is therefore necessary to apply particularly severe manufacturing checks.

The problem remains the same if, instead of using two separate stirrup members for the two connecting terminals concerned, a single stirrup member is provided, cut out from sheet metal, common to the two connecting terminals and fixed relative to the insulating material body, as is the case, for example, in French patent application No. 69 43938 filed Dec. 18, 1969 and publised under the No. 2.071.130.

In this case it is still necessary to form two threaded holes in a stirrup member of this kind.

To alleviate the problem it has been proposed to fabricate a single stirrup member of this kind in the solid, using a brass extrusion, for example, as this is easier to thread, as is the case in French Pat. No. 1.572.097 filed July 25, 1968 or in French patent application No. 74 19520 filed June 6, 1974 and published under the No. 2.234.675.

A solution of this kind inevitably results in increased consumption of materials, however, and this is all the more serious in that in this case a relatively costly material is employed.

In French Pat. No. 1.231.072 this problem is circumvented by the fact that the threaded hole needed for the clamping screw of each of the connecting terminals is separated from the stirrup member, instead being formed on the corresponding cable clamp.

This features a threaded bore, in the same way as a nut, but differs from a real nut in that the threaded bore is blind.

This cable clamp is in practise disposed within the stirrup member and the clamping screw with which it is associated is itself immobilized axially relative to the stirrup member although it is free to rotate relative to it, the connecting link common to the two connecting terminals being formed by the corresponding wall of said stirrup member.

However, in this French Pat. No. 1.231.072 the stirrup member does not of itself constitute a generally tubular part, meaning a part whose four walls are all in one piece with each other.

To the contrary, it is formed by a trough-shaped part, on the one hand, and, on the other hand, a median part separate from the former and to be attached to it, with transverse pins for fastening these two parts to each other.

The overall result is some degree of complexity and therefore increased cost.

A second problem in manufacturing side connection terminal blocks of the kind with which this description is concerned relates to the fitting and fastening together of the various parts employed.

This difficulty is all the greater in that at present the clamping screws always project at least partly out of the stirrup member or members concerned.

It is then necessary to orient the stirrup member or members appropriately relative to the insulating material body, and also to orient appropriately relative to this the associated connecting link when any such connecting link is provided, to engage the connecting link with the stirrup member or members and then to begin screwing the clamping screws into the stirrup member or members, fitting to them the corresponding cable clamp and, to finish off, fitting the assembly into the insulating material body, as is the case with the terminal block which is the subject of the French Pat. No. 69 43938 mentioned hereinabove, or to begin by placing the stirrup member or members in the insulating material body, begin screwing the clamping screws into the stirrup member or members and, to finish off, fitting to the clamping screws the corresponding cable clamps, as is the case with the terminal block which is the subject of the French Pat. No. 1.572.097 also mentioned hereinabove, or, finally, to carry out these operations, or similar operations depending on the fabrication method employed, in a different order.

In all cases such assembly entails manipulating a relatively large number of parts in various directions and such manipulation is all the more difficult in that these parts are initially independent of each other and their individual orientations are difficult to identify.

Because of this such assembly is difficult to mechanize and in practise the machines on which it is done frequently malfunction, compromising their productivity.

Similarly, assembly the terminal block described in the French Pat. No. 1.231.072 mentioned hereinabove entails operating from the side, in order to fit the pins fastening to each other the two component parts of the corresponding stirrup member.

Also, special clamping screws are required in all cases, to suit the associated cable clamps.

This is the case, for example, in French Pat. No. 1.572.097 in which a cable clamp of this kind consists of a part attached to the end of the clamping screw with the result that the clamping screw has to have an annular groove near its end, and this is also the case in French Pat. No. 69.43938, in which the cable clamp associated with a clamping screw extends between the head and the end thereof, with the result that the head must have an appropriate profile, being in practise produced on a screw cutting machine.

This is also the case in French Pat. No. 1.231.072, in which the head of the clamping screw is also produced on a screw cutting machine, featuring at its base a collar through which it bears on the lower surface of the median part concerned of the stirrup member, whereas its remaining part passes right through said median part, thus extending essentially through the thickness thereof.

A general object of the present invention is an arrangement enabling this difficulties to be circumvented and also procuring other advantages.

To be more precise, an object of the present invention is a side connection terminal block of the kind comprising in an insulating material body, for constituting at least two connecting terminals, a stirrup member fixed relative to said insulating material body which is common to the two connecting terminals and which, laterally at each end, is accessible from the outside of said insulating material body through a lateral opening therein, for inserting an electrical conductor, and a clamping screw for each connecting terminal which is immobilized axially relative to the stirrup member but free to rotate relative thereto, and a cable clamp adapted to press said electrical conductor against a connecting link common to the two connecting terminals when acted on by said clamping screw, said cable clamp being disposed inside said stirrup member, prevented from rotating relative thereto and interlocked with said clamping screw, the terminal block being generally characterized in that the clamping screw for each of the connecting terminals is entirely disposed within the stirrup member common thereto.

The single stirrup member employed is advantageously made of a copper alloy, brass or bronze, for example, or sheet steel with a higher conductivity surface layer, such as a film of brass of copper, for example, appropriately cut out and folded, a stirrup member of this kind then advantageously of itself constituting the associated connecting link and of itself implementing an electrical connection function between the connecting terminals in addition to a mechanical resistance to clamping function.

As an alternative, the stirrup member may equally well be made of appropriately cut out and bent sheet steel with which there is associated, internally, independently and in a manner that is known per se, a connecting link in a higher conductivity material, such as a link of brass or copper, for example, a stirrup member of this kind then essentially having only a mechanical resistance to clamping function whereas the electrical connection function is implemented by the associated connecting link.

Be this as it may, being intended to be accommodated completely within the stirrup member, the clamping screw of each connecting terminal may advantageously be engaged in the associated cable clamp in advance, whereby assembly is facilitated.

For example, each clamping screw/cable clamp assembly to be used may be inserted into the stirrup member from the side.

The corresponding operations, which are carried out on simple parts the individual orientation of which is easy to identify, are advantageously relatively easy to mechanize.

This is the case if, by way of an alternative, the stirrup member comprises a transverse opening for its engagement with such a clamping screw/cable clamp assembly, the assembly procedure then amounting to a simple stacking operation in one direction only of the various component parts needed, the stirrup member, as it were, capping each of the clamping screw/cable clamp assemblies previously fitted into the insulating material body.

In either case, accurate positioning of the various parts in question relative to each other may be achieved.

In all cases advantageous and economic use may be made of simple, standard clamping screws not requiring the use of a screw cutting machine and which may be fabricated by simple stamping.

Also, as they are not threaded, the holes that the stirrup member has to feature to provide access to the clamping screws of the two connecting terminals may advantageously and economically be obtained simply by punching the stirrup member.

Furthermore, as their size is independent of the diameter of the threaded shank of the clamping screws, they may advantageously of themselves constitute selection members imposing the choice of an appropriate size screwdriver for operating the clamping screws, preventing excessive torque being applied to these wit the risk of damaging the assembly.

Be this as it may, these holes in any event serve to guide a screwdriver so that it is possible to dispense with the guidance wells usually provided in the insulating material body to give access to the clamping screws, which economically simplifies fabrication of the insulating material bodies.

As a corollary to this, the threaded hole that the associated cable clamps feature preferably extends through all of the height of the cable clamp, passing right through it, so that the cable clamps constitute true nuts.

In practise they are simple sections of rolled or extruded brass or another material of moderate hardness.

The operations to be applied to any such section are easy to mechanize.

Starting, for example, with an extrusion of rectangular transverse cross-section, a square cross-section, for example, it is possible on the same machine to bore the extrusion axially, to thread it, to cut it to the required length and, optionally, to fit a screw into each of the threaded sections of the extrusion thus obtained.

A process of this kind is all the more economical in that, for connecting terminals with different specifications the same transverse cross-section and same thread diameter may be employed for the cable clamps, which would differ from each other only in terms of their length, as appropriate to the terminal blocks to which they are to be fitted, and the corresponding clamping screws themselves differing only in the length of their threaded shank.

Finally, by virtue of the fact that, in accordance with the invention, the clamping screws lie wholly within the stirrup member, their head bears strongly against the inside surface of the upper wall thereof when a clamping action is applied to them.

Conjointly with the elastic deformation reaction force then due to the stirrup member, the friction resulting from this contact of the clamping screws with the inside surface of the upper wall of the stirrup member is advantageously favorable to good retention of the clamping screws.

In other words, the risk of unwanted loosening of these is advantageously minimized.

This is all the more so in that, in accordance with the invention, the clamping screws bear against the top of the stirrup member on a surface which develops in a circumferentially continuous manner around the corresponding holes and which thus has a significant circumferential dimension.

In outline, the overall result of all that has been described previously is that, all other things being equal, the arrangement in accordance with the invention advantageously procures an overall reduction in costs and particularly reliable and secure products.

The characteristics and advantages of the invention will emerge from the following description given by way of example with reference to the accompanying schematic drawings in which:

FIGS. 14, 15 and 16 are views analogous to those of FIGS. 1, 2 and 3, respectively, and relating to a further embodiment.

Figure 1:
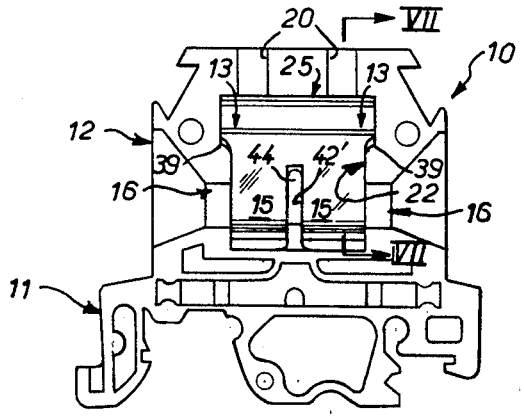
FIG. 1 is a view in elevation of a terminal block in accordance with the invention.

As shown in these figures, and in the manner which is known per se, a terminal block in accordance with the invention comprises a generally plate-shaped insulating material body 10.

The base of the insulating material body 10 forms a foot 11 through which it is adapted, for example and as shown here, to be fitted to at least one particular type of standardized rail or extrusion (these arrangements not relevant to the present invention and well known in themselves are not described in detail here) and its main part forms a superstructure 12 in which are disposed, side by side and electrically connected to each other, two connecting terminals 13.

In a manner also known per se, each of these connecting terminals 13 itself comprises, for clamping any form of electrical conductor, to be more precise the previously bared end of the conductive core thereof, a generally tubular stirrup member 15 which is laterally accessible from outside the insulating material body 10 through an opening 16 therein, and a cable clamp 17 which, when acted on by a clamping screw 18 itself accessible from outside the insulating material body 10 by virtue of a well 20 in the latter, is adapted to press said electrical conductor against a connecting link to be explained later.

Overall, the thus constituted connecting terminals 13 are disposed in a housing 22 provided for them in the superstructure 12 of the insulating material body 10, and this housing 22 discharges transversally and freely onto one of the main surfaces of the insulating material body 10.

Thus the housing 22 is generally cup-shaped, outwardly open, and in service it may be closed either by the insulating material body of a terminal block adjacent the first-mentioned block or by a closure plate attached thereto.

In the embodiments shown it has a four-sided overall contour.

The openings 16 and the wells 20 which are formed in the edge of the superstructure 12 of the insulating material body 10 discharge internally into the housing 22 which the latter thus features.

As, using the terminology adopted here, this is a side connection terminal block, the openings 16 are lateral openings, that is to say openings on the lateral edge surfaces of the insulating material body 10, said openings 16 extending substantially perpendicularly to the axis of the associated wells 20 which are in the front edge surface.

As a corollary to this, the stirrup members 15 are aligned with the axis of the lateral openings 16 and therefore substantially perpendicularly to the axis of the wells 20.

In practise, the stirrup members 15 are in one piece with each other.

In other words, they form together a single stirrup member 25 common to the two connecting terminals 13.

This single stirrup member 25 is fixed into the insulating material body and is laterally accessible at each end from outside said insulating material body through the corresponding lateral opening 16 therein.

In the embodiments shown the single stirrup member 25 thus employed is in copper alloy or in sheet steel with a higher conductivity surface film, such as a film of brass or copper, for example.

It thus of itself provides the necessary electrical connection between the connecting terminals 13 without any specific connecting link having to be associated with it for this purpose.

In other words, in this case it constitutes of itself a connecting link of this kind.

In transverse cross-section the single stirrup member 25 has a generally four-sided contour, with rounded corners, and its width is substantially equal to the depth of the housing 22 in the insulating material body 10, so that it can be inserted into this housing 22 in the thickness of said insulating material body 10.

It also has a four-sided contour in plan view, reflecting that of the housing 22, in order to immobilize it therein.

In practise the single stirrup member 25 is obtained by folding a strip of sheet metal in such a way that the extreme edges thereof close the one on the other.

In the embodiment specifically shown in FIGS. 1 through 8, the single stirrup member 25 comprises, perpendicularly to a wall 26 which forms it median part on the same side as the wells 20 in the insulating material body 10, and one on either side of this wall 26, two lateral walls 27, 27'; opposite said wall 26 it comprises, parallel thereto, a wall 28 formed by superposing the one on the other two right-angle lips 29, 29' on said lateral walls 27, 27', respectively.

These two right-angle lips 29, 29' are appropriately fastened together, as by welding, for example.

This is the case in the embodiment shown in FIGS. 1 through 8.

As an alternative to this, they may equally well be fastened together by semi-punching or any other means.

Be this as it may, the walls 26, 27, 27' and 28 of the thus constituted single stirrup member 25 are in one piece with each other.

The wall 26, which is the top wall, comprises for each connecting terminal 13 a hole 35 to provide access to the clamping screw 18 thereof, of circular contour and the diameter D1 of which is less than that D2 of the head 36 of the clamping screw 18, as measured at the level of the corresponding transverse end face thereof.

In accordance with the invention, for each of the connecting terminals 13 the clamping screw 18, which is axially immobilized relative to the single stirrup member 25 but free to rotate relative to it, is entirely disposed within the single stirrup member 25.

In practise the cable clamp 17 that is associated with it is a nut also disposed within said single stirrup member 25, prevented from rotating relative to it, and interlocked with a clamping screw 18 of this kind.

Also, for each of the connecting terminals 13 the head 36 of the clamping screw 18 is engaged between, on the one hand, the wall 26 of the single stirrup member 25 opposite the corresponding cable clamp 17 and, on the other hand, a shoulder 37 axially immobilized relative to said single stirrup member 25.

In the embodiment specifically shown in FIGS. 1 through 8, this soulder 37 is formed by a step on one at least of the lateral walls 27, 27' of the single stirrup member 25, in practise one on each of them.

Also, in this embodiment the stirrup member 25 has a T-shaped contour as seen in elevation, each of its lateral walls 27, 27' having a step 38 on its edge and, correspondingly, the contour of the housing 22 in the insulating material body 10 is of complementary T-shape.

Furthermore, in the embodiment shown in FIGS. 1 through 8, in line with the head 36 of the clamping screw 18 of each of the connecting terminals 13, one at least of the lateral walls 27, 27' of the single stirrup member 25 forms a localized retaining tab 39 facing the other.

Figure 6:
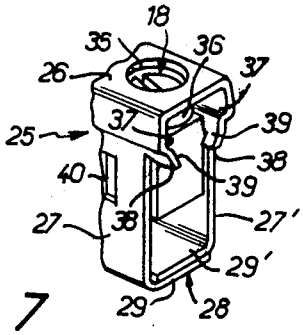
FIG. 6 is a partial view in perspective, repeating that of FIG. 3 in part, relating to the stirrup member once the corresponding clamping screw/cable clamp assemblies have been fitted to it.

In practise, in this embodiment a retaining tab 39 of this kind is provided on each of the lateral walls 37, 27' of the single stirrup member 25 and, as shown in FIG. 6 for one lateral end of the single stirrup member 25, it results from simple deformation of the lateral walls 27, 27' at the base of their step 38.

Also, in the embodiment shown in FIGS. 1 through 8, for each connecting terminal 13 the single stirrup member 25 comprises, internally, at least one rib 40 adapted to guide the corresponding cable clamp 17.

In practise, in this embodiment there is provided only one such rib 40 for each connecting terminal 13 and, being formed in the lateral wall 27 of the single stirrup member 25 by simple localized stamping thereof, it runs over part only of the height of said single stirrup member 25.

Finally, in the embodiment shown, each of the lateral walls 27, 27' of the single stirrup member 25 has in its median area, over part of its height running from the wall 28 of the single stirrup member 25, a slot 42, 42' which also extends over part of said wall 28, to substantially half-height.

Conjointly, the insulating material body 10 features in one piece with it and projecting over the bottom of its housing 22 a partition wall 43 which, over part of its height running from its free edge, is extended by a lug 44.

Figure 2:
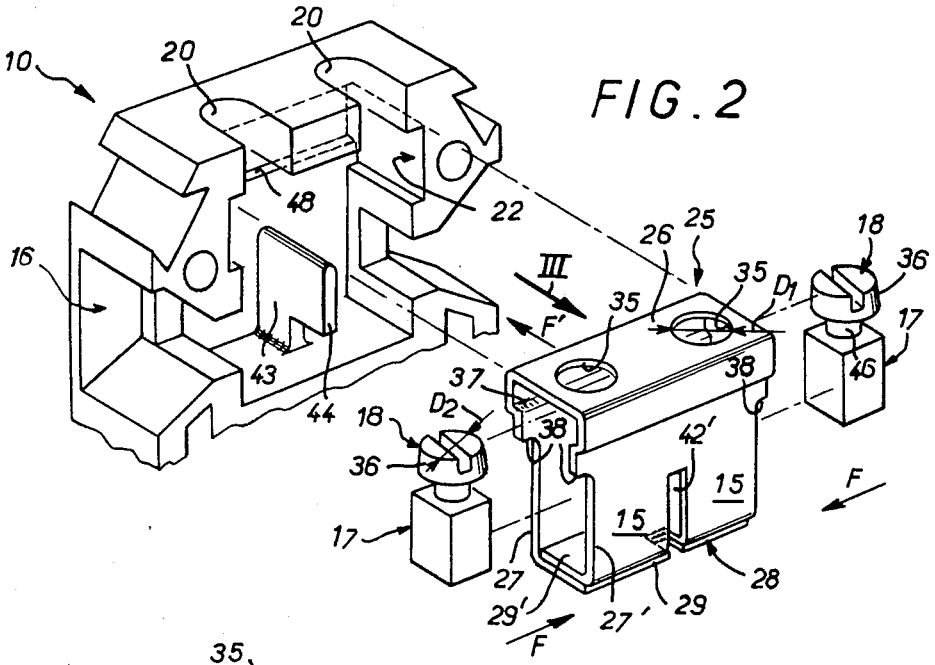
FIG. 2 is a partial exploded view in perspective of this terminal block.
Figure 3:
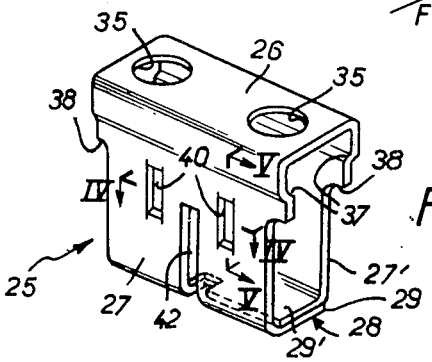
FIG. 3 is a perspective view in the direction of the arrow III in FIG. 2 of the stirrup member employed in this terminal block, shown in isolation, prior to inserting in it the clamping screw/cable clamp assemblies to be fitted to it.
Figure 4:
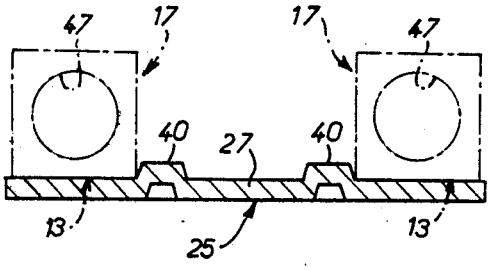
FIGS. 4 and 5 are partial views of this stirrup member to a different scale in cross-section on lines IV—IV and V—V, respectively, in FIG. 3.
Figure 5:
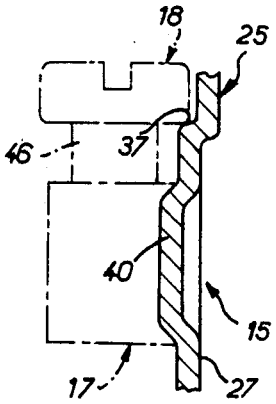
Figure 7:
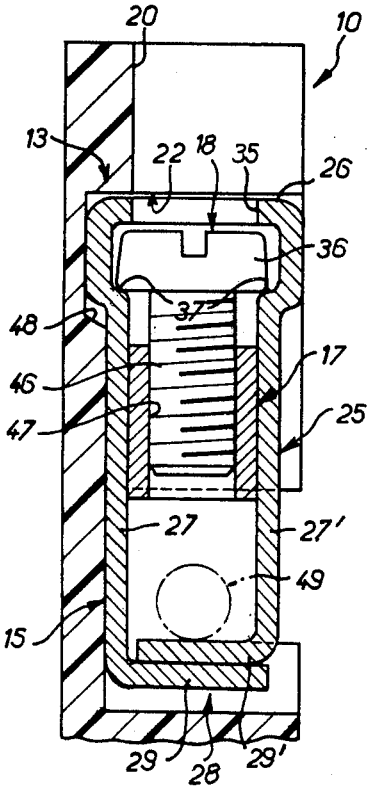
FIG. 7 is a partial view of the terminal block in accordance with the invention to a larger scale and in transverse cross-section on the line VII—VII in FIG. 1, prior to clamping an electrical conductor.
Figure 8:
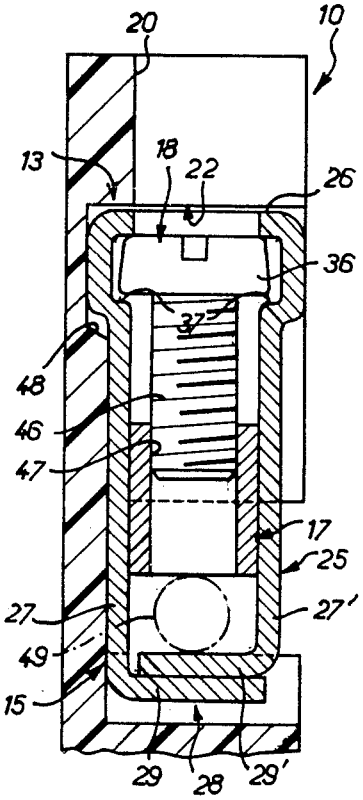
FIG. 8 is a view analogous to that of FIG. 7, after clamping the electrical conductor.

Also, given the transverse step 38 that the lateral walls 27, 27' of the single stirrup member 25 features, the bottom of the housing 22 in the insulating material body 10 features a corresponding groove 48 (FIGS. 2, 7 and 8).

Also, the clamping screw 18 of each of the connecting terminals 13 is a simple screw of standard manufacture which, apart from its head 36, comprises a threaded shank 46 and the nut that the cable clamp 17 associated with it forms is a simple extruded or rolled section which has a substantially four-sided profile in transverse cross-section, for example a square profile as shown here, featuring a dimension perpendicular to the bottom of the housing 22 in the insulating material body 10 slightly less than that separating the walls 27, 27' of the single stirrup member 25, so that it can slide between these, and has an axial threaded bore 47 adapted for cooperation screwthread-wise with said threaded shank 46 of a clamping screw 18.

As shown here, this threaded bore 47 preferably extends over the full height of the cable clamp 17, passing right through it, which simplifies its manufacture.

At assembly tim the cable clamps 17 are pre-assembled to the corresponding clamping screws 18, as shown in FIG. 2.

The clamping screw 18/cable clamp 17 assemblies thus constituted are inserted laterally into the single stirrup member 25, at the corresponding lateral ends thereof, in the direction of the arrows F in FIG. 2, with the head 36 of the clamping screws 18 inserted between the top wall 26 of the single stirrup member 25 and the steps 37 in its lateral walls 27, 27'.

After this insertion, which is continued until the cable clamps 17 butt up against the corresponding ribs 40 on the lateral wall 27 of the single stirrup member 25, the retaining tabs 39 are bent over on this lateral wall 27 and on the associated lateral wall 27'.

The clamping screw 18/cable clamp 17 assemblies are then captive, being trapped within the single stirrup member 25.

The single stirrup member 25 thus fitted with clamping screw/cable clamp 17 assemblies is in turn inserted into the housing 22 in the insulating material body 10, in the direction of the arrow F' in FIG. 2.

On completion of such insertion the extension 44 of the partition wall 43 of the insulating material body 20 passes completely through the single stirrup member 25 by virtue of the slots 42, 42' in the lateral walls 27, 27' thereof.

The corresponding end edge of this extension 44 is then preferably deformed, as by hot crimping, for example, so as to immobilize the single stirrup member 25 in the insulating material body 10 and thus secure it in place therein.

To use the resulting terminal block all that is necessary is, as is usually the case and as schematically represented in dashed line in FIGS. 7 and 8, to insert the previously bared end 49 of an electrical conductor into each of the lateral openings 16 in the insulating material body 10 until it penetrates into the corresponding lateral end of the single stirrup member 25, beneath the clamping screw 18 of the connecting terminal 13 concerned, and then to turn this clamping screw 18.

The clamping screw 18 being immobilized axially relative to the single stirrup member 25 by its head 36 and the single stirrup member 25 itself being immobilized within the insulating material body 10 by virtue of its nesting in the housing 22 thereof, any rotation of the clamping screw 18 results in axial displacement of the cable clamp 17 in the direction of the height of the single stirrup member 25 because the cable clamp 17 is prevented from rotating relative to the latter.

By appropriately choosing the threads concerned, the arrangement is preferably such that rotation to the right of the screw 18 results in movement of the cable clamp 17 in the direction away from the head 36 of the clamping screw 18, in order to clamp the bared end 49 of the electrical conductor concerned against the wall 28 of the single stirrup member 25 opposite the wall 26 comprising the holes 35 (FIG. 8), this wall 28, which is the bottom wall of the single stirrup member 25, thus of itself forming, in all essentials, the associated connecting link.

Conjointly with this, the head 36 of the clamping screw 18 bares through its front surface, that is to say its upper transverse surface, on the inside surface of the wall 26 of the single stirrup member 25, which is its top wall or surface.

It will be noted that when the clamping screw 18 is turned the screwdriver employed for this purpose is correctly guided by the corresponding hole 35 in the single stirrup member 25, the screwdriver having to be passed through this hole 35 to obtain access to the head 36 of the clamping screw 18.

In the alternative embodiment shown in FIGS. 9 through 13, which corresponds in practise to electrical and mechanical specifications different to those applicable to the embodiment previously described with reference to FIGS. 1 through 8, it is the upper wall 26 of the single stirrup member 25 which is formed by two right-angle lips 29, 29' on the lateral walls 27, 27'.

In practise, in the embodiment shown the right-angle lips 29, 29' are clipped together.

As shown here, for example, a lug 50 is cut into the right-angle lip 29, which is that on the outside, and—appropriately lengthened for the purpose—it is inserted into an opening 51 formed at least in part in the right-angle lip 29', which is the inside one, said opening 51 in practise extending also into the corresponding lateral wall 27'.

Figure 13:
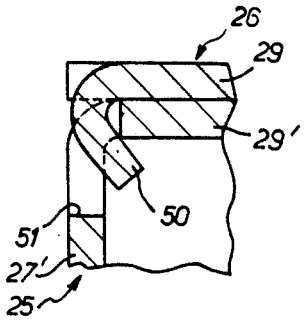
FIG. 13 is another partial view of this stirrup member to the same scale as FIG. 12 and in transverse cross-section on the line XIII—XIII in FIG. 10.

To secure the necessary clipping action the lug 50 is bent under the righ-angle lip 29' beyond the opening 51 through which it is passed (FIG. 13).

Furthermore, in this embodiment the shoulder 37 at the same level in each of the lateral walls 27, 27' of the single stirrup member 25 forms part of a cup 55 produced by locally diestamping the lateral wall 27, 27'.

Figure 9:
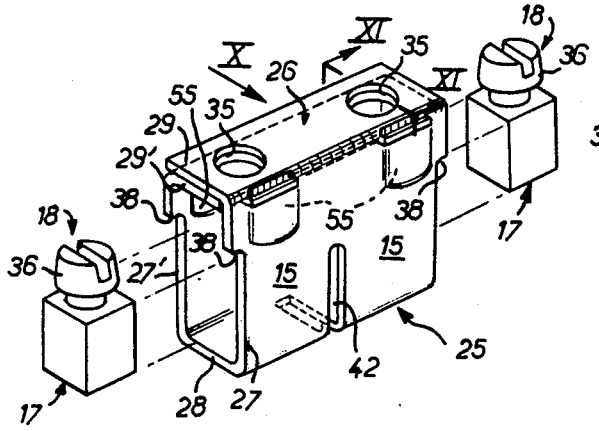
FIGS. 9 and 10 are perspective views repeating in part those of FIGS. 2 and 3 and relating to an alternative embodiment.
Figure 10:
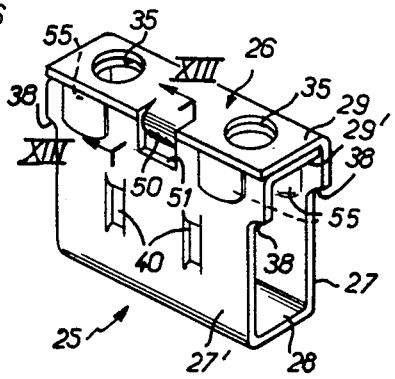
Figure 11:
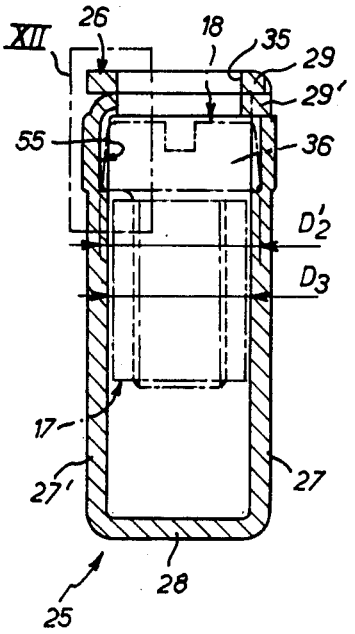
FIG. 11 is a view to a different scale of the stirrup member employed in this alternative embodiment in transverse cross-section on the line XI—XI in FIG. 9.
Figure 12:
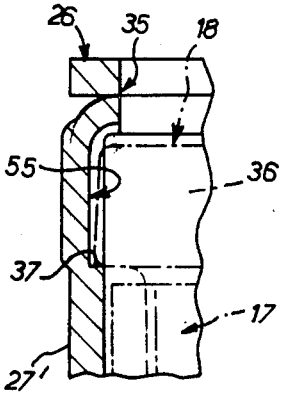
FIG. 12 shows to a larger scale the detail of FIG. 11 marked by a frame XII thereon.

In practise a cup 55 of this kind is provided in this way for the head 36 of each of the clamping screws 18, the external trace of which is seen in FIGS. 9 and 10.

At its base at least the head 36, which is in practise generaly frustoconical, has a diameter D'2 greater than the internal width D3 of the single stirrup member 25 and it is force fitted into said single stirrup member 25, by virtue of elastic deformation thereof, until it locates in the cup 55 recessed for it in the inside surface of the lateral walls 27, 27' thereof.

An arrangement of this kind advantageously prevents loss of the clamping screw 18/cable clamp 17 assemblies once they have been fitted into the single stirrup member 25, without it being necessary to provide on the stirrup member any form of retaining tabs, as previously described.

Finally, in the embodiment shown in FIGS. 9 through 13 only the lateral wall 27 of the stirrup member 25 features a slot 42, this also extending significantly into the lower wall 28 of the single stirrup member 25.

Unlike the previous embodiment, it is therefore necessary in this case to insert the single stirrup member 25 into the housing 22 in the insulating material body 10 in a particular direction.

In all other respects, however, the arrangements and the assembly are of the same kind as previously described.

In the embodiment shown in FIG. 14 through 16 the single stirrup member 25 comprises for each connecting terminal 13 a transverse window 57 which is interlocked with the corresponding clamping screw 18/cable clamp 17 assembly by simple transversal, rather than lateral, insertion relative to the assembly, in the direction of the arrow F' in FIG. 15.

In practise, in the embodiment shown the windows 57 that the single stirrup member 25 thus features in accordance with the invention are each of generally four-sided contour and, being formed only in the lateral wall 27 of the single stirrup member 25, they each extend over the major part of the lateral wall 27, from the top wall 26 of said single stirrup member 25 to a point in line with the respective hole 35 in this wall 26.

Each window 57 is sufficiently large to encompass a clamping screw/cable clamp 17 assembly and so to permit the necessary engagement of the single stirrup member 25 over such an assembly.

To leave clearance for the head 36 of the clamping screws 18 and thus to minimize its thickness, the lateral wall 27' of the single stirrup member 25 opposite that 27 comprising the windows 57 itself comprises, each in correspondence with the respective window 57 and in line with the head 36 of the clamping screws 18, two openings 59.

Of limited size relative to that of the windows 57, these openings 59 are also of generally four-sided contour in the embodiment shown and, like the windows 57, they extend from the wall 26 of the single stirrup member 25 featuring the openings 35.

In this embodiment, each clamping screw 18 conjointly features a non-threaded section 60 between its head 36 and its threaded shank 46, near the head 36, and through this non-threaded section it is adapted to be engaged with a collar 61 axially fixed relative to the single stirrup member 25.

In practise this collar 61 is in one piece with the insulating material body 10 and projects from the bottom of the housing 22.

To be interlocked with the corresponding clamping screw 18, to be more precise with the non-threaded section 60 thereof, by simple lateral engagement relative to the clamping screw 18, the collar 61 features a slot 62.

To achieve this it in practise consists of two elastically deformable arms 63 which conjointly define between them a housing 64 the diameter of which is slightly less than that of the reduced diameter section 60 of the corresponding clamping screw 18; through the slot 62, the width of which is less than said diameter, this housing 64 communicates with the outside, on the same side as the outlet from said housing 22 in the insulating material body 10.

To facilitate insertion of the clamping screw 18 into the slot 62, which constitutes to a bottleneck, so to speak, the elastically deformable arms 64 have oblique insertion facets facing each other and leading into the slot 62.

This applies to both the connecting terminals 13.

Also, in this embodiment and as for the embodiment shown in FIGS. 1 through 8, it is the bottom wall 28 of the single stirrup member 25 which is formed by two right-angle lips 29, 29' on the lateral walls 27, 27' thereof.

As described with reference to the embodiment shown in FIGS. 9 through 13, these right-angle lips 29, 29' are clipped to each other.

However, in the embodiment shown in FIGS. 14 through 16 there are two lugs 50, each inserted into an opening 51 and folded back beyond the latter.

These openings 51, each of which is in line with a respective window 57, are in the lateral wall 27 whereas the lugs 50 form extensions of the innermost right-angle lip 29' of the lateral wall 27'.

As in the embodiment shown in FIGS. 9 through 13, only the lateral wall 27 of the single stirrup member 25 features a slot 42 in the embodiment shown in FIGS. 14 through 16.

Finally, in this embodiment right-angle lip 29 on the lateral wall 27 of the single stirrup member 25 is extended downwardly at right angles by a tab 67 and, differing in this from the previous arrangements, at its root the internal partition wall 43 of the insulating material body 10 extends over all the width or depth of its housing 22, featuring a step 68 at a distance from this root and over the remainder of its height.

At assembly time, and as previously, the cable clamps 17 are first pre-assembled to the corresponding clamping screw 18, as shown in FIG. 2.

The non-threaded sections 60 of the clamping screws 18 of the resulting clamping screw 18/cable clamp 17 assemblies are then inserted into the collars 61 provided for them on the insulating material body 10.

In practise such insertion is effected substantially perpendicularly to the bottom of the housing 22, in the direction of the arrow F' in FIG. 15.

It entails momentary elastic separation of the arms 63 constituting each of the collars 61, before these close agains around the corresponding clamping screw 18.

The single stirrup member 25 is then fitted, being also inserted into the opening 22 perpendicular to the bottom thereof, in the direction of the arrow F' in FIG. 15.

By means of its openings 57 the single stirrup member 25 is then conjointly engaged on the clamping screw 18/cable clamp 17 assemblies previously fitted and on the partition wall 43 that the insulating material body 10 features.

On completion of this insertion the tab 67 on the single stirrup member 25 bears against the edge of this internal partition wall 43 of the insulating material body 10.

Provision may naturally be made for securing the single stirrup member 25 in its housing 22 on completion of such insertion, by welding, bonding with an adhesive or snap-fastener fashion, for example.

It will be noted that the resulting terminal block is assembled by a simple stacking operation and that in the terminal block the single stirrup member 25 of itself retains the clamping screws 18.

As previously these are therefore captive and the corresponding cable clamps 17 along with them.

Also as previously, the clamping screws 18 are entirely disposed within the single stirrup member 25 and, in order to obtain access to their head 36, it is necessary to pass through the corresponding holes 35 in the stirrup member.

Finally, the head 36 of each of the clamping screws 18 is, as previously, engaged between, on the one hand, the wall 28 of the single stirrup member 25 opposite the corresponding cable clamp 17 and, on the other hand, a shoulder 37 axially fixed relative to said single stirrup member 25, the should 37 being formed in this instance by the upper transverse face of the corresponding collar 61.

Thus the clamping screws 18 are also immobilized axially relative to the single stirrup member 25.

It will be understood that the present invention is not limited to the embodiments described and shown but encompasses any variant execution and/or combination of their various component parts.

Specifically, for the purpose of the electrical connection to be made there may be associated, internally, with the single stirrup member employed, and independently thereof, a specific connecting link of conductive material, such as copper or brass, for example, especially when the single stirrup member is simply formed from sheet steel.

In all cases it will be noted that, in service when the electrical conductors appropriately fitted are clamped down, by virtue of the arrangement in accordance with the invention the front or top surface of the clamping screws is at best in contact with the inside surface of the upper wall of the stirrup member, said clamping screws then cooperating bearing fashion with said inside surface through their said front surface, and that, in the absence of any electrical conductor, this front surface is short of said inside surface of the top wall of the stirrup member.

In other words, the head of the clamping screws is entirely engaged between the upper wall of the stirrup member and one or more shoulders axially fixed relative thereto.

To put this another way, the front surface of the head of the clamping screws lies inside the stirrup member, that is to say inside the volume delimited internally by the inside surface of the walls thereof.

What we claim is:

1. A side connector terminal block of the kind housed in an insulating material body and defining at least two connecting terminals, said terminal block comprising a generally tubular stirrup member fixed inside the insulating material body, said stirrup member defining in part each of the two connecting terminals, a lateral opening being provided in the insulating material body for providing access to each of the ends of said stirrup member and permitting insertion of an electrical conductor, each connecting terminal further comprising a clamping screw being restrained against axial movement within said stirrup member but being free to rotate within said stirrup member, each clamping screw having a head housed between a wall and a shoulder integral with said stirrup member, and each connecting terminal further having a cable clamp disposed inside said stirrup member axially remote from said wall of said stirrup member and threadably engaged with a corresponding one of said clamping screws, means preventing said cable clamps from rotating inside said stirrup member, said clamping screws being entirely disposed within said stirrup member, each of said cable clamps being displaceable in response to turning of the corresponding clamping screw to press the electrical conductor against a second wall defining a connecting link which provides a conductive path common to the two connecting terminals, said shoulder for each of said connecting terminals being formed by a step in a lateral wall of said stirrup member.

2. A side connector terminal block of the kind housed in an insulating material body and defining at least two connecting terminals, said terminal block comprising a generally tubular stirrup member fixed inside the insulating material body, said stirrup member defining in part each of the two connecting terminals, a lateral opening being provided in the insulating material body for providing access to each of the ends of said stirrup member and permitting insertion of an electrical conductor, each connecting terminal further comprising a clamping screw being restrained against axial movement within said stirrup member but being free to rotate within said stirrup member, each clamping screw having a head housed between a wall and a shoulder integral with said stirrup member, and each connecting terminal further having a cable clamp disposed inside said stirrup member axially remote from said wall of said stirrup member and threadably engaged with a corresponding one of said clamping screws, means preventing said cable clamps from rotating inside said stirrup member, said clamping screws being entirely disposed within said stirrup member, each of said cable clamps being displaced in response to turning of the corresponding clamping screw to press the electrical conductor against a second wall defining a connecting link which provides a conductive path common to the two connecting terminals, said shoulder forming part of a cup-shaped portion in a lateral wall of said stirrup member.

3. A terminal block according to claim 2, wherein the head of each of said clamping screws has, at lest at its base, a diameter greater than the internal width of said stirrup member and is accommodated in the corresponding cup-shaped portion, the head of each of said clamping screws being force fitted into said stirrup member.

4. A side connector terminal block of the kind housed in an insulating material body and defining at least two connecting terminals, said terminal block comprising a generally tubular stirrup member fixed inside the insulating material body, said stirrup member defining in part each of the two connecting terminals, a lateral opening being provided in the insulating material body for providing access to each of the ends of said stirrup member and permitting insertion of an electrical conductor, each connecting terminal further comprising a clamping screw being restrained against axial movement within said stirrup member but being free to rotate within said stirrup member, each clamping screw having a head housed between a wall and a shoulder associated with said stirrup member, and each connecting terminal further having a cable clamp disposed inside said stirrup member axially remote from said wall of said stirrup member and threadably engaged with a corresponding one of said clamping screws, means preventing said cable clamps from rotating inside said stirrup member, said clamping screws being entirely disposed within said stirrup member, each of said cable clamps being displaceable in response to turning of the corresponding clamping screw to press the electrical conductor against a second wall defining a connection link which provides a conductive path common to the two connecting terminals, said wall of said stirrup member opposite the corresponding cable clamp comprising a hole having a diameter less than that of said head providing access to the head of the corresponding clamping screw.

5. A terminal block according to claim 4, wherein a non-threaded section of the clamping screws of each connecting terminal is in mating engagement with a collar fastened to the insulating material body and defining said shoulder.

6. A terminal block according to claim 4, wherein, for each of the connecting terminals, said stirrup member comprises internally at least one rib for guiding the corresponding cable clamp.

7. A terminal block according to claim 4, wherein said one wall of said stirrup member is formed by two lips which are superposed and secured to each other.

8. A terminal block according to claim 7, wherein one of said lips has at least one cut-out lug which is inserted into an opening of a lateral wall and bent back over the other of said lips in overlapping relationship.

9. A terminal block according to claim 4, wherein, for each of the connecting terminals, said stirrup member comprises a transverse window disposed between said wall and a second wall opposed from said wall and within one of two spaced lateral walls for permitting positioning of the corresponding clamping screw/cable assembly within in said stirrup member.

10. A terminal block according to claim 9, wherein for each of the connecting terminals, a wall of said stirrup member opposite that in which said transverse window is formed comprises an opening in line with the head of the corresponding clamping screw.

11. A terminal block according to claim 4, wherein a lateral wall of said stirrup member forms a screw retaining tab facing towards an opposite lateral wall of said stirrup member and proximate to the head of the corresponding clamping screw.

12. A terminal block according to claim 11, wherein said stirrup member is made of copper alloy, brass or bronze, or of sheet steel with a higher conductivity surface film such as a film of brass or copper, whereby said stirrup member itself defines the common connective path.

13. A terminal block according to claim 11, wherein all walls of said stirrup member are in one piece with each connecting one another.

14. A terminal block according to claim 11, wherein the cable clamp of each of said connecting terminals comprises a nut having a bore extending therethrough the entire height of which is threaded.

* * * * *